US006056677A

United States Patent [19]

Chin

[11] Patent Number: 6,056,677

[45] Date of Patent: May 2, 2000

[54] FLEXOR FOR BODY BUILDING

[76] Inventor: Hsiao-Yi Chin, 7th Fl., No. 227, Sec. 3, Roosevelt Rd., Taipei, Taiwan

[21] Appl. No.: 09/159,181

[22] Filed: Sep. 23, 1998

[51] Int. Cl.[7] ..... A63B 21/045

[52] U.S. Cl. ..... 482/127

[58] Field of Search ..... 482/121, 131, 482/140

[56] References Cited

U.S. PATENT DOCUMENTS 4,343,465 8/1982 Allen ..... 482/905
4,852,873 8/1989 O'Donnell et al. ..... 272/137
5,022,648 6/1991 Travis ..... 272/137
5,957,820 9/1999 Zarillo et al. ..... 482/121

*Primary Examiner*—Richard J. Apley
*Assistant Examiner*—Jayne Saydah
*Attorney, Agent, or Firm*—William E. Pelton, Esq.

[57] ABSTRACT

A flexor for body building includes an elongated flexible member having two ends, a pair of handles arranged at respective ends of the flexible member, and a device for releasably connecting and securely fastening the handles to the ends of the flexible member such that each of the handles may be adjusted to a desired angle with respect to the flexible member. The flexible member has sufficient resistance to a torque exerted by a user in average health.

8 Claims, 7 Drawing Sheets

FLEXOR FOR BODY BUILDING

FIELD OF THE INVENTION

The present invention relates to a flexor for body building and, more particularly, to a flexor with adjustable handles so as to form a desired angle with respect to the flexible member of the flexor.

BACKGROUND OF THE INVENTION

A flexor is a device for body building. FIG. 5 shows a flexor (40) that includes a flexible member (42) terminating in a pair of handles (44, 46), by which a user can apply a torque upon the member (42) repeatedly for the purpose of stretching and, hence, strengthening his/her muscles. However, the conventional flexor (40) can only be used to strengthen the muscle of the user's arms, this significantly limits the usage thereof.

FIG. 6 illustrates a flexor (50) having a flexible member (52) with a pair of curved handles (56, 58) secured at the ends thereof. The flexible member (50) is covered around by a sheath (54) made of a spongy material, which allows the flexible member (50) to be pressed against the neck, belly or back of the user to strengthen the muscles of the user at different body portions.

Although the flexor (50) of FIG. 6 can provide multiple functions compared with the flexor (40) of FIG. 5, it is still not suitable for all user of different heights, because handles (56, 58) of the flexor (50) are not adjustable to fit different users.

SUMMARY OF THE INVENTION

The object of the present invention is to provide a flexor in which the handles are adjustable to form a desired angle with respect to a flexible member of the flexor.

DETAILED DESCRIPTION OF PREFERRED EMBODIMENT

Figure 1:
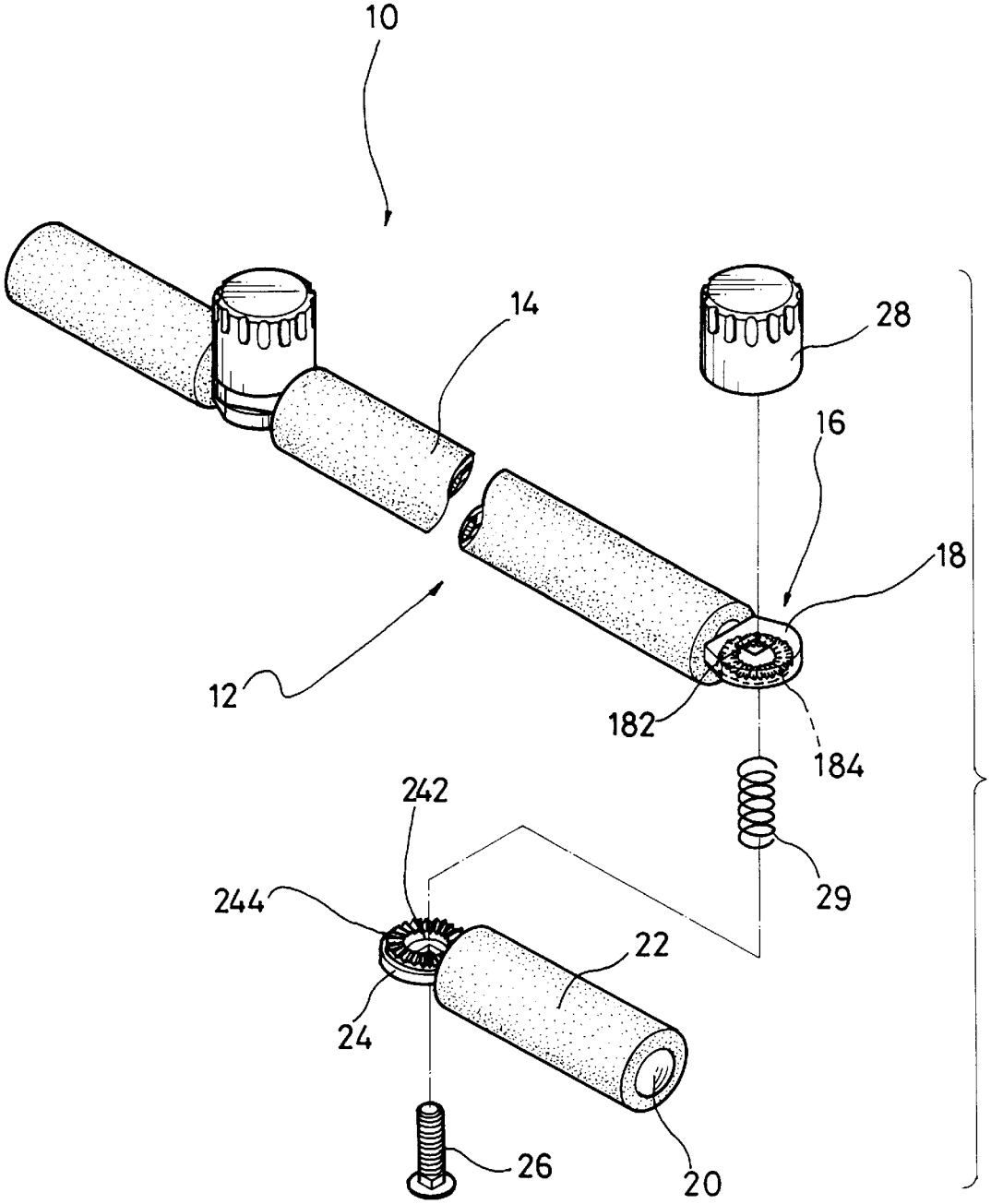
FIG. 1 is a perspective exploded view of a preferred embodiment of a flexor in accordance with the present invention.

Referring to FIG. 1, a preferred embodiment of a flexor (10) for body building, in accordance with the present invention, includes an elongated flexible member (12) having sufficient resistance to a torque exerted by a user in average health, and a pair of handles (20) arranged at respective ends of the member (12).

The flexible member (12) is covered by a sheath (14) made of a spongy material and has a pair of joints (16) at respective ends thereof. Each of the joints (16) includes a first circular disk (18) having a through-hole (182) with a plurality of first teeth (184) extending radially therefrom.

The handles (20) are also covered by sheathes (22) made of a spongy material to provide an attractive soft feeling for a user when he/she grips the handles (20). Each of the handles (20) has a second circular disk (24) integrally formed at an end thereof to mate one of respective first circular disks (18) of the flexible member (12). The second circular disk (24) has a second hole (242) aligned with the first hole (182) and a plurality of second teeth (244) engaged with the first teeth (184) of the first disk (18).

Figure 2:
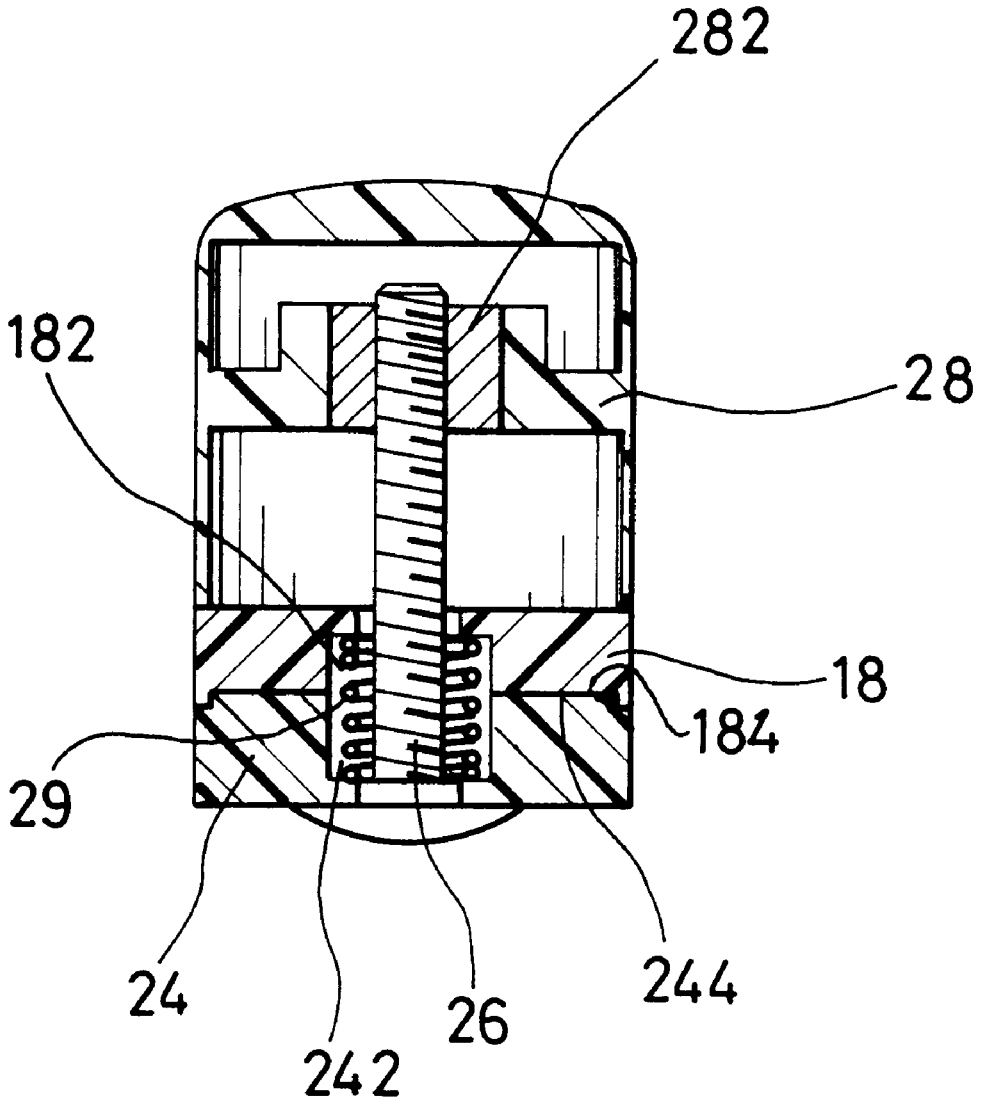
FIG. 2 is a schematic cross-sectional view, in part, showing the flexor handle joint of FIG. 1 in assembly.

Referring to FIG. 2, the flexible member (10) and the handle (20) are assembled by a bolt (26) which extends through the holes (242, 182) of the first and second disks (24, 18), terminating in a nut (28) having a threaded sleeve (282) threadingly engaged with the bolt (26) to sandwich the first and second disks (18, 24) tightly therebetween. In this manner, the teeth (184, 244) of the first and second disks (18, 24) may positively prevent the relative rotational movement of the handle (20) with respect to the flexible member (12).

Figure 3:
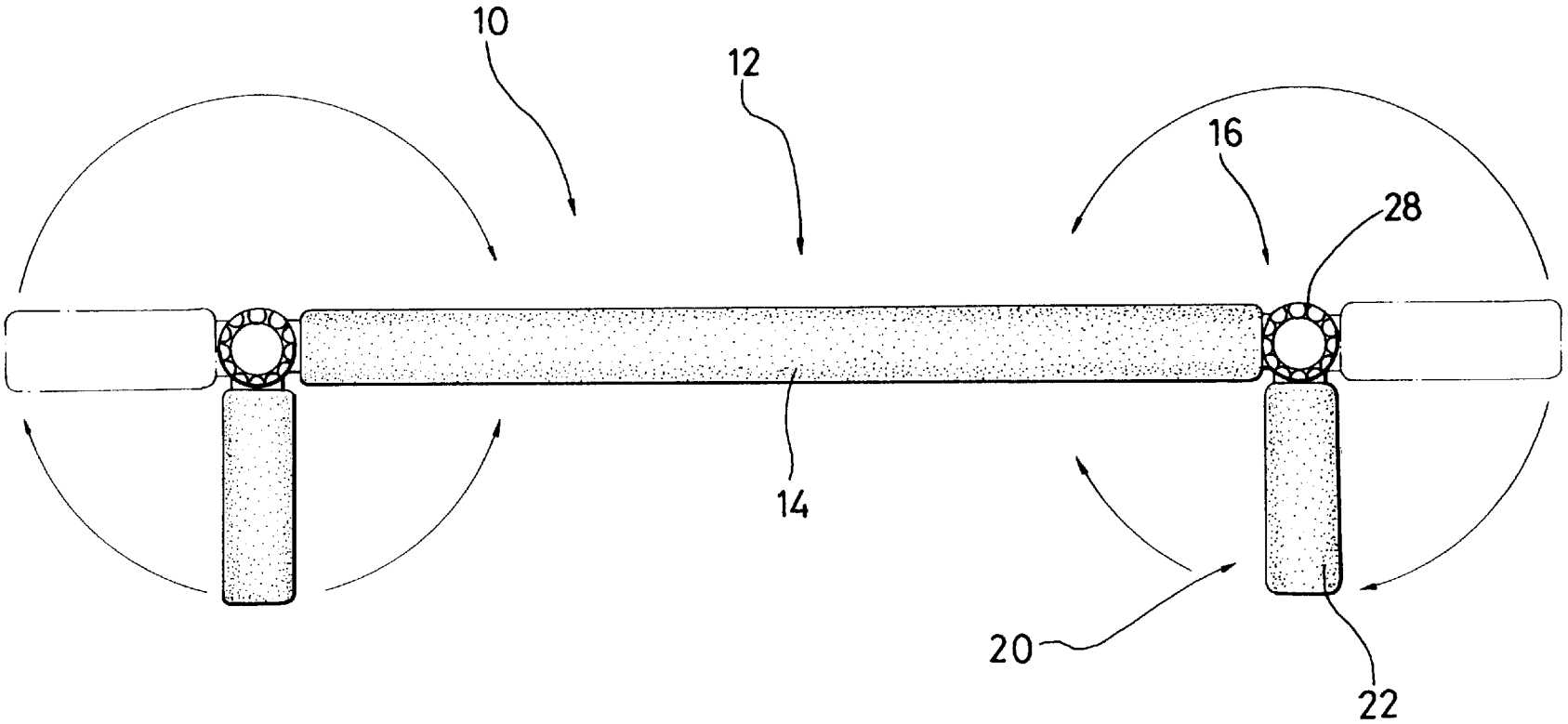
FIG. 3 is a schematic top view of the flexor shown in FIGS. 1 and 2.

Referring to FIGS. 1 and 3, each handle (22) may be adjusted to a particular position relative to the flexible member (12), depending upon the height and the preference of the user as well as the muscles to be strengthened, by way of loosening the nut (28) and disengaging the teeth (244) of the handle (20) from the teeth (184) of the flexible member (12). The handle (20) is then rotated relative to the flexible member (12) about the bolt (26) to a position at a desired angle with the flexible member (12). This process is completed by screwing the nut (28) tightly onto the bolt (26) again.

Referring to FIGS. 1 and 2, there is preferably a spring (29) disposed between the disks (18, 24) of the flexible member (12) and the handle (20) to separate the disks (18, 24) from each other when the nut (28) is loosened, thus automatically disengaging the teeth (184, 244) of the disks (18, 24) from one another.

Figure 1A:
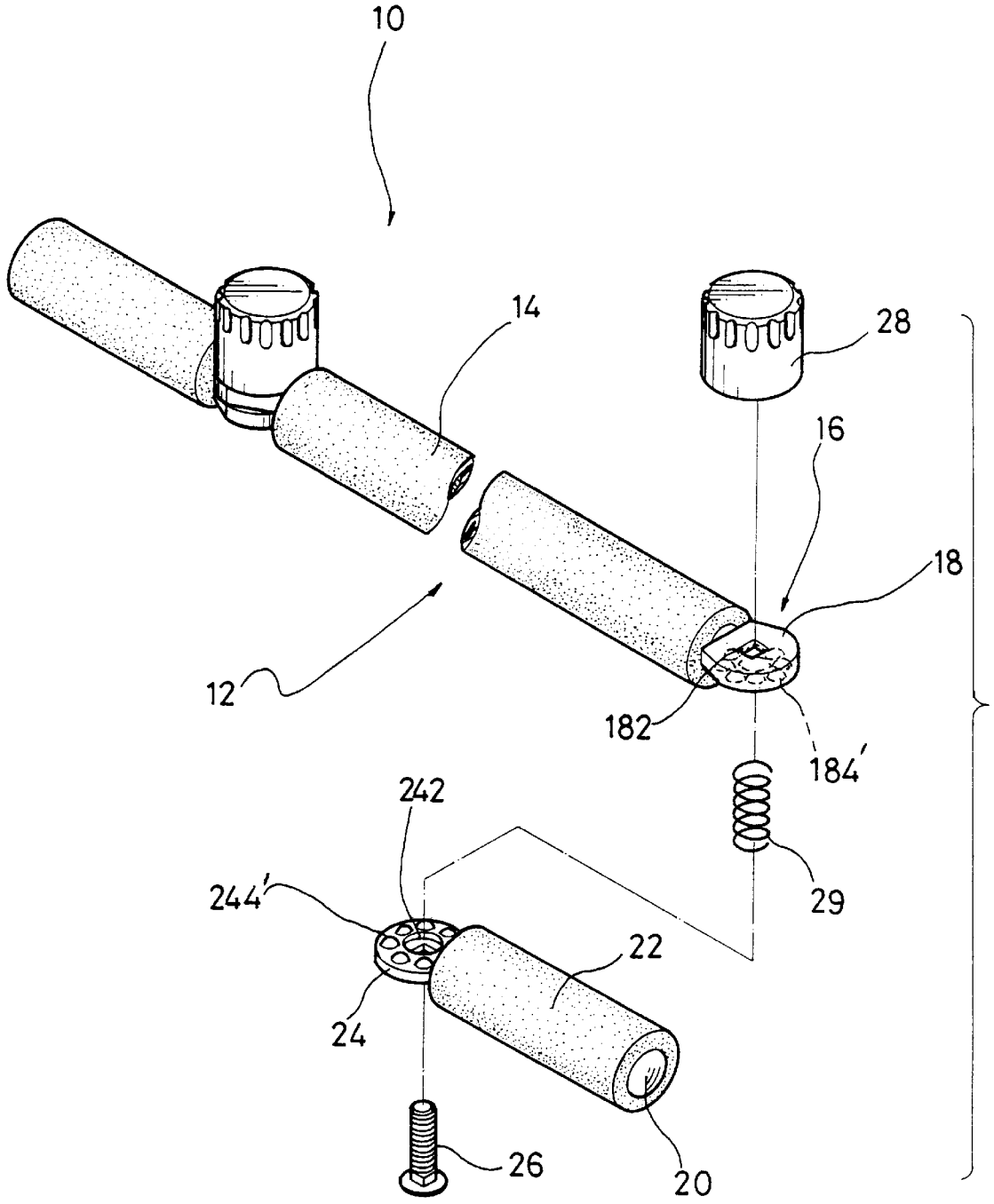
FIG. 1A is an alternative embodiment of the flexor in accordance with the present invention.

It is apparent to those skilled in the art that various modifications may be made to the above-mentioned embodiment, for example, the first teeth (184) of the first circular disk (18) of the flexible member (12) may be replaced by a plurality of lugs (184') protruding therefrom about the through-hole (182), and accordingly, the second teeth (244) of the second circular disk (24) of the handle (20) may be replaced by a plurality of recesses (244') arranged and shaped to mate with the lugs (184'), as shown in FIG. 1A.

Figure 4:
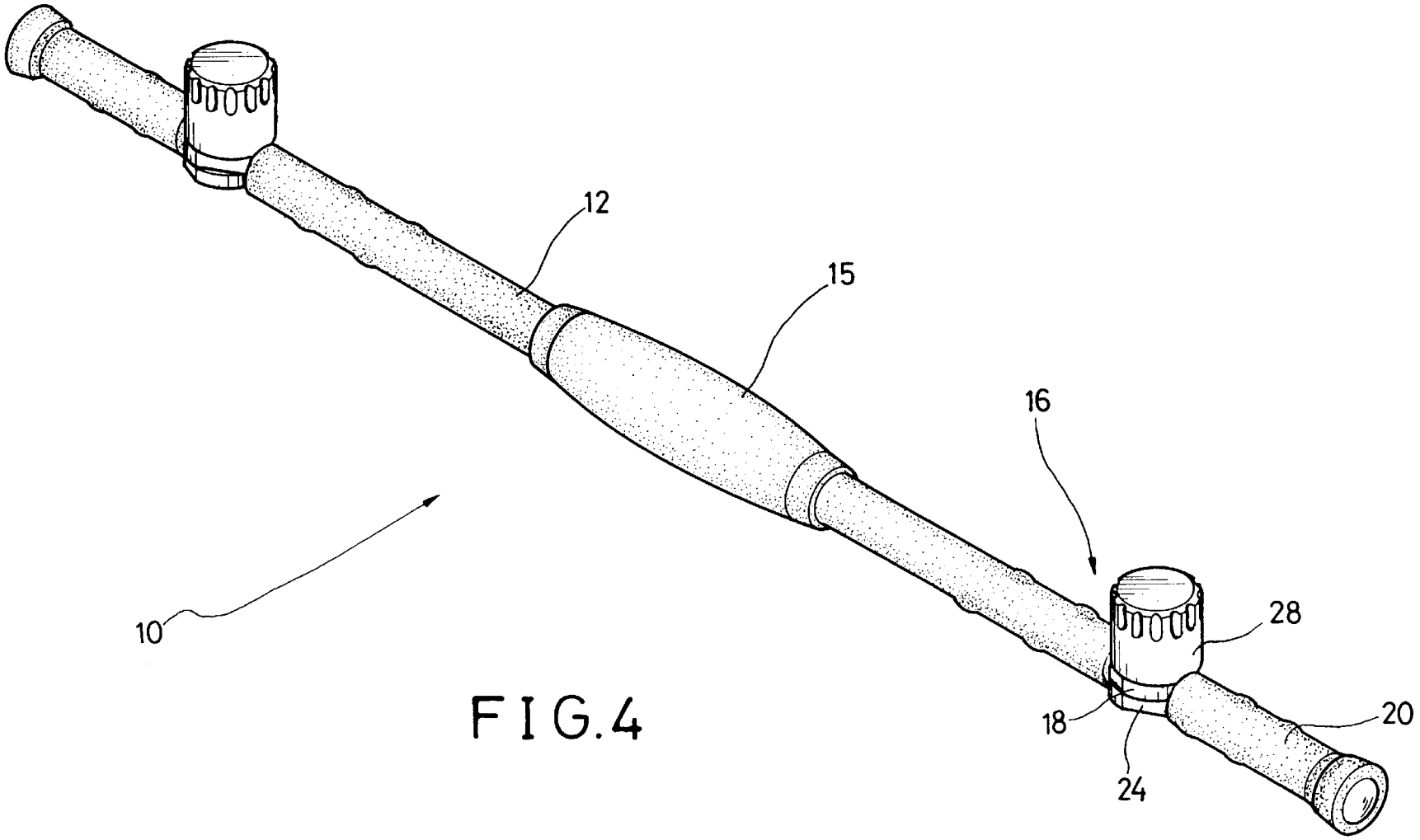
FIG. 4 is a perspective view of another embodiment of a flexor in accordance with the present invention.
Figure 5:
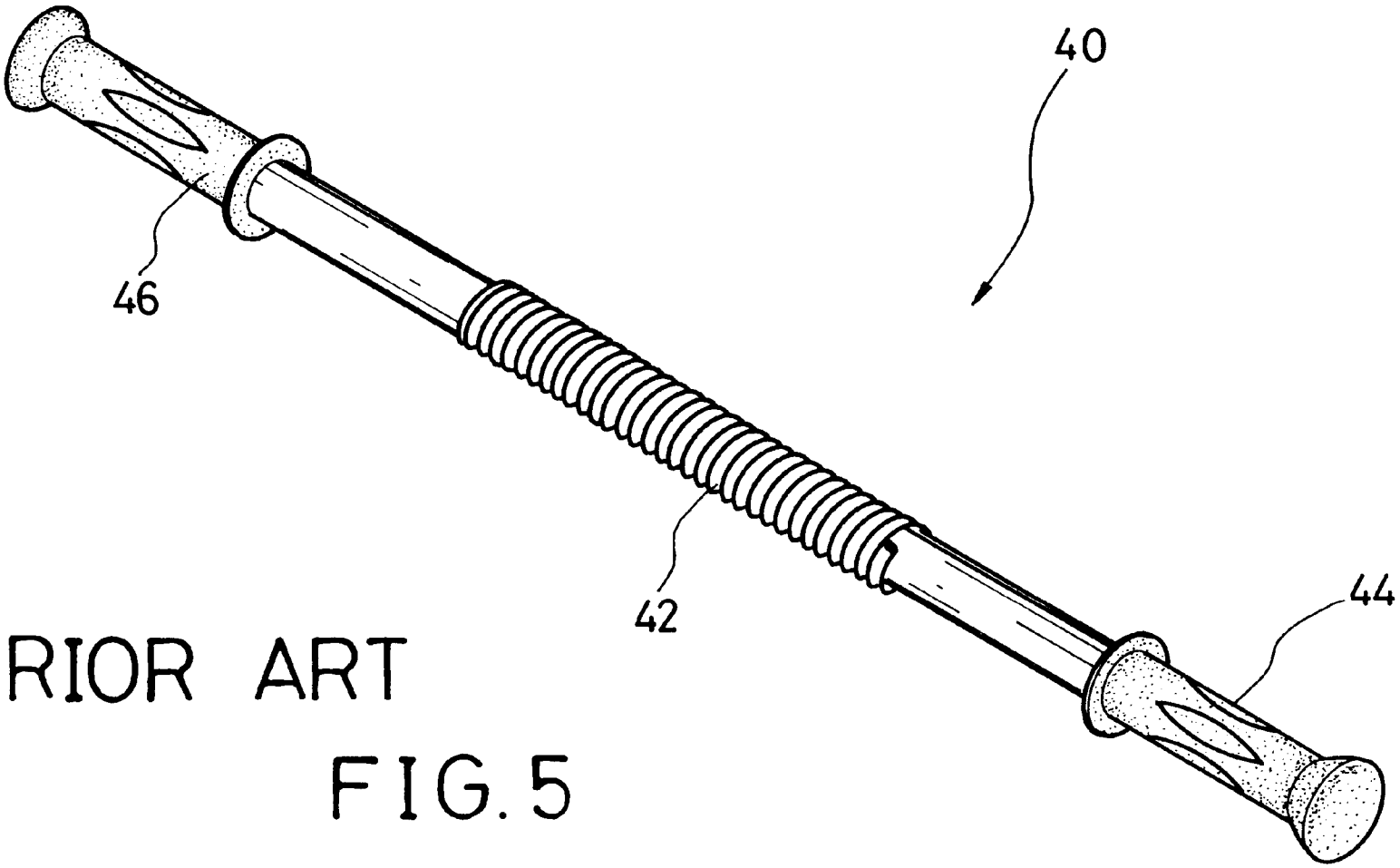
PRIOR ART FIG. 5
FIG. 5 is a perspective view of a conventional flexor for body building.
Figure 6:
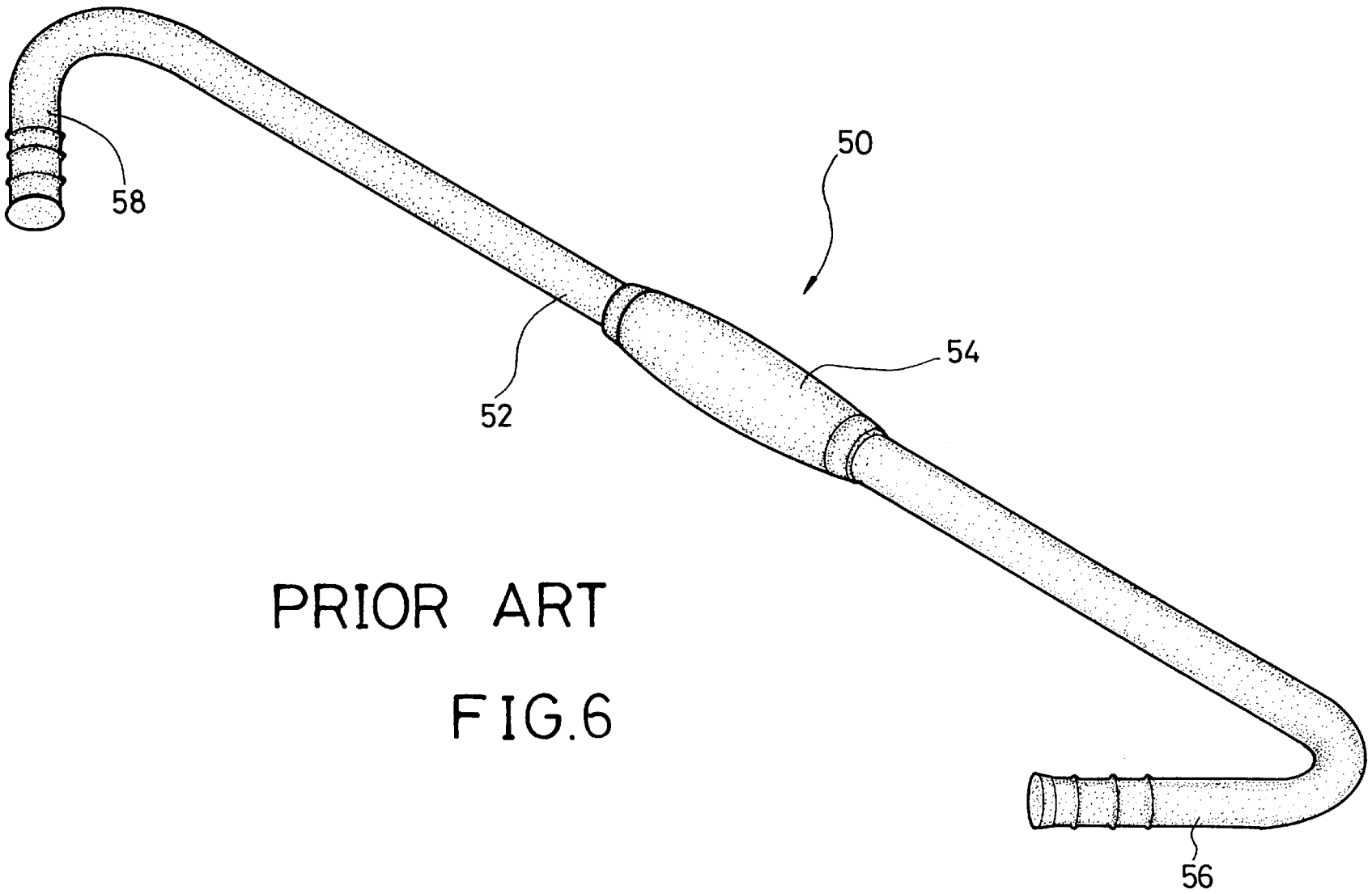
PRIOR ART FIG.6
FIG. 6 is a perspective view of another conventional flexor for body building.

In addition, the sheath (14) may extend the full length of the flexible member (12) between the first disks (18) thereof, as shown in FIG. 1, or alternatively, the sheath (14) may be disposed at the midpoint of the flexible member (12) and shaped somewhat like an olive, as shown in FIG. 4.

What is claimed is:

1. A flexor for body building, comprising:

an elongated flexible member having two ends;

a pair of handles arranged at respective ends of said flexible member; and means for releasably connecting and securely fastening said handles to said ends of said flexible member such that each of said handles may be adjusted to a desired angle with respect to said flexible member, said means for connecting and fastening said handles comprising:

a pair of first disks each being formed at a respective end of said flexible member and having a first hole and a plurality of first teeth;

a second disk formed at an end of each handle and having a second hole and a plurality of second teeth engagable with said first teeth upon alignment of said first and second holes;

a bolt extending through said first and second holes;

a nut threadingly connected with said bolt to sandwich said first and second disks tightly therebetween;

a spring received between said first and second disks;

wherein said flexible member has sufficient resistance to a torque exerted by a user in average health.

2. The flexor as claimed in claim 1, wherein said first and second disks are circular in shape and have said holes defined in the centers thereof.

3. The flexor as claimed in claim 2, wherein said first and second disks each have a plurality of teeth arranged radially from said holes thereof.

4. The flexor as claimed in claim 1, wherein said nut has a threaded sleeve to be threadingly connected with said bolt.

5. The flexor as claimed in claim 1, wherein said flexible member has a sheath made of a spongy material therearound.

6. The flexor as claimed in claim 5, wherein said sheath extends the full length of said flexible member between said first disks thereof.

7. The flexor as claimed in claim 5, wherein said sheath is disposed at the midpoint of said flexible member, and is shaped like an olive.

8. The flexor as claimed in claim 7, wherein each of said handles has a sheath made of a spongy material.

* * * * *